US006452192B1

(12) United States Patent
Kohda

(10) Patent No.: US 6,452,192 B1
(45) Date of Patent: Sep. 17, 2002

(54) RADIATION IMAGE STORAGE PANEL

(75) Inventor: Katsuhiro Kohda, Kaisei-machi (JP)

(73) Assignee: Fuji Photo Film Co., Ltd., Kanagawa-Ken (JP)

( * ) Notice: Subject to any disclaimer, the term of this patent is extended or adjusted under 35 U.S.C. 154(b) by 45 days.

(21) Appl. No.: 09/695,979

(22) Filed: Oct. 26, 2000

(30) Foreign Application Priority Data

Oct. 26, 1999 (JP) ..... 11-303914

(51) Int. Cl.[7] ..... G21K 4/00
(52) U.S. Cl. ..... 250/484.4; 250/484.1
(58) Field of Search ..... 250/484.4, 484.1, 250/484.3, 484.2, 581, 585, 588; 428/690, 691

(56) References Cited

U.S. PATENT DOCUMENTS

| | | | | | |
|---|---|---|---|---|---|
| 4,380,702 | A | | 4/1983 | Takahashi et al. | 250/327.2 |
| 4,621,196 | A | | 11/1986 | Arakawa | 250/483.1 |
| 4,728,583 | A | * | 3/1988 | Yamazaki et al. | 428/690 |
| 4,944,026 | A | * | 7/1990 | Arakawa et al. | 250/484.1 |
| 5,378,897 | A | | 1/1995 | Suzuki | 250/484.4 |
| 6,246,063 | B1 | * | 6/2001 | Fukui | 250/484.4 |
| 6,333,513 | B1 | * | 12/2001 | Iwabuchi | 250/587 |
| 2001/0022349 | A1 | * | 9/2001 | Takahashi | 250/582 |

FOREIGN PATENT DOCUMENTS

| | | | |
|---|---|---|---|
| EP | 0 347 171 A2 | 12/1989 | |
| EP | 0 886 282 A1 | 12/1998 | |
| JP | 56-12600 | 2/1981 | G21K/4/00 |
| JP | 59-162500 | 9/1984 | G21K/4/00 |
| JP | 60-174898 | 9/1985 | C25D/17/08 |
| JP | 10 96923 | 4/1998 | |

OTHER PUBLICATIONS

Database WPI, Section CH, Wekk 200002, Derwent Publications Ltd., London, GB, Class K08, AN 2000–016714, XP002176872 & JP 11 281795 A (Fuji Photo Film Co., Ltd.) Oct. 15, 1999.

* cited by examiner

*Primary Examiner*—Constantine Hannaher
*Assistant Examiner*—Otilia Gabor
(74) *Attorney, Agent, or Firm*—Sughrue Mion, PLLC

(57) ABSTRACT

A radiation image storage panel comprises a stimulable phosphor layer, which contains a stimulable phosphor, and a light reflecting layer, which contains a light reflecting substance and is overlaid on one surface of the stimulable phosphor layer. A scattering length of the light reflecting layer with respect to light having wavelengths falling within a stimulation wavelength range for the stimulable phosphor is at most 5 $\mu$m. The light reflecting substance may be a white pigment. The light reflecting substance may have a bulk density of at most 1 mg/cm$^3$ or a BET specific surface area of at least 1.5 m$^2$/g. The light reflecting substance may have a mean particle size falling within the range of 1/4 of the stimulation wavelengths to two times as large as the stimulation wavelengths. The radiation image storage panel is capable of emitting light having a high intensity and furnishing a radiation image having good image quality with a high sharpness.

11 Claims, 2 Drawing Sheets

RADIATION IMAGE STORAGE PANEL

BACKGROUND OF THE INVENTION

1. Field of the Invention

This invention relates to a radiation image storage panel. This invention particularly relates to a radiation image storage panel comprising a stimulable phosphor layer and a light reflecting layer, which contains a light reflecting substance and is overlaid on one surface of the stimulable phosphor layer.

2. Description of the Related Art

In lieu of conventional radiography, radiation image recording and reproducing techniques utilizing a stimulable phosphor have heretofore been used in practice. The radiation image recording and reproducing techniques utilizes a radiation image storage panel (referred to also as the stimulable phosphor sheet) provided with a stimulable phosphor. With the radiation image recording and reproducing techniques, the stimulable phosphor of the radiation image storage panel is caused to absorb radiation, which carries image information of an object or which has been radiated out from a sample, and thereafter the stimulable phosphor is exposed to an electromagnetic wave (stimulating rays), such as visible light or infrared rays, which causes the stimulable phosphor to produce the fluorescence (i.e., to emit light) in proportion to the amount of energy stored thereon during its exposure to the radiation. The produced fluorescence (the emitted light) is photoelectrically detected to obtain an electric signal. The electric signal is then processed, and the processed electric signal is utilized for reproducing a visible image on a recording material.

The radiation image recording and reproducing techniques have the advantages in that a radiation image containing a large amount of information can be obtained with a markedly lower dose of radiation than in the conventional radiography. Therefore, the radiation image recording and reproducing techniques are efficient particularly for direct medical radiography, such as the X-ray image recording for medical diagnosis.

The radiation image storage panel utilized for the radiation image recording and reproducing techniques has a basic structure comprising a substrate and a stimulable phosphor layer overlaid on one surface of the substrate. In cases where the stimulable phosphor layer has self-supporting properties, the radiation image storage panel need not necessarily be provided with the substrate. Ordinarily, the stimulable phosphor layer is constituted of a layer, which comprises a binder and a stimulable phosphor dispersed in the binder. Alternatively, the stimulable phosphor layer may be constituted of a stimulable phosphor evaporated layer, a stimulable phosphor sintered layer, or the like. The stimulable phosphor has the properties such that, when the stimulable phosphor is caused to absorb radiation, such as X-rays, and is then exposed to an electromagnetic wave (stimulating rays), such as visible light or infrared rays, the stimulable phosphor emits light in proportion to the amount of energy stored thereon during its exposure to the radiation. Therefore, when the radiation image storage panel is exposed to the radiation, which carries image information of an object or which has been radiated out from a sample, the stimulable phosphor layer of the radiation image storage panel absorbs the radiation in proportion to the dose of radiation, and a radiation image of the object or the sample is stored as an image of energy from the radiation on the radiation image storage panel. The radiation image storage panel is then exposed to the stimulating rays, and the image having been stored on the radiation image storage panel can be detected as the light emitted by the radiation image storage panel. The emitted light is detected photoelectrically to obtain an image signal, the image signal is processed, and the thus obtained processed image signal can then be utilized for reproducing the radiation image of the object or the sample as a visible image.

As described above, the radiation image recording and reproducing techniques are the advantageous image forming techniques. As in the cases of an intensifying screen employed in the conventional radiography, it is desired that the radiation image storage panel utilized for the radiation image recording and reproducing techniques has a high sensitivity and can yield an image of good image quality (with respect to sharpness, graininess, and the like).

As a technique for enhancing the sensitivity of the radiation image storage panel, a technique, wherein a light reflecting layer is formed on a substrate by, for example, applying a coating composition, which contains an appropriate binder and a white pigment dispersed in the binder, onto the substrate, and a stimulable phosphor layer is then formed on the light reflecting layer, has heretofore been known. The radiation image storage panel provided with the light reflecting layer, which is constituted of a white pigment, is disclosed in, for example, Japanese Unexamined Patent Publication No. 56(1981)-12600. In Japanese Unexamined Patent Publication No. 56(1981)-12600, as white pigments, titanium dioxide, white lead, zinc sulfide, aluminum oxide, and magnesium oxide are exemplified.

As for a stimulable phosphor employed in the radiation image storage panel, a bivalent europium activated alkaline earth metal (particularly, barium) fluorohalide phosphor has heretofore been known as a preferable phosphor for a high luminance of emitted light, and the like. The emission spectrum of the bivalent europium activated alkaline earth metal fluorohalide phosphor is a band spectrum ranging from the near ultraviolet region to the blue region and has a light emission peak in the vicinity of 390 nm. In cases where a stimulable phosphor, which emits light of the near ultraviolet region besides the visible region, is employed in the radiation image storage panel (the bivalent europium activated alkaline earth metal fluorohalide phosphor described above emits light of the near ultraviolet region with an intensity higher than the intensity of light of the visible region), if a light reflecting layer constituted of one of the white pigments exemplified in Japanese Unexamined Patent Publication No. 56(1981)-12600, which white pigments are other than magnesium oxide, is formed between the substrate and the stimulable phosphor layer in order to enhance the sensitivity of the radiation image storage panel, the problems described below will occur. Specifically, the white pigments exemplified in Japanese Unexamined Patent Publication No. 56(1981)-12600, which white pigments are other than magnesium oxide, exhibit a high reflectivity with respect to light of the visible region and a markedly low reflectivity with respect to light of the near ultraviolet region (i.e., the reflection spectra of the white pigments do not extend to the near ultraviolet region). Therefore, the light reflecting layer constituted of one of the aforesaid white pigments cannot have sufficiently high light reflection characteristics. Accordingly, in cases where the radiation image storage panel is provided with the light reflecting layer constituted of one of the aforesaid white pigments, the sensitivity of the radiation image storage panel cannot always be enhanced sufficiently.

Therefore, research has heretofore been conducted to make an improvement of the radiation image storage panel from the aspect of the material for the light reflecting layer constituted of a white pigment. For example, in Japanese Unexamined Patent Publication No. 59(1984)-162500, it has been disclosed that an alkaline earth metal fluorohalide represented by the formula $M^{II}FX$, in which $M^{II}$ is at least one of Ba, Sr, and Ca, and X is at least one of Cl and Br, may be utilized as a white pigment.

Also, a radiation image storage panel provided with a light reflecting layer, in which an oxide of a metallic element radiating out secondary X-rays having energy of 38 keV to 60 keV is employed as a pigment, is proposed in, for example, Japanese Unexamined Patent Publication No. 6(1994)-174898. With the proposed radiation image storage panel, in cases where the sensitivity of the radiation image storage panel is kept at a predetermined level, a radiation image having a high sharpness can be furnished. Also, with the proposed radiation image storage panel, in cases where a radiation image having a predetermined sharpness may be obtained, the radiation image can be formed with an enhanced sensitivity.

As described above, enhancement of the reflectivity of the light reflecting layer with respect to light emitted by the stimulable phosphor is still an important subject. The reflectivity of the light reflecting layer with respect to light emitted by the stimulable phosphor depends upon the thickness of the light reflecting layer. Therefore, if the thickness of the light reflecting layer is set at a large value, the reflectivity of the light reflecting layer can be enhanced in proportion to the increase in the thickness of the light reflecting layer. However, with the conventional pigments, even if the thickness of the light reflecting layer is set at a large value and a high reflectivity is obtained, the image quality of the obtained radiation image cannot much be enhanced for the reasons described below.

FIG. 4 is an explanatory view showing how stimulating rays incident upon a light reflecting layer are scattered in the light reflecting layer in cases where the thickness of the light reflecting layer is set at a large value so as to obtain a high reflectivity of the light reflecting layer with respect to light emitted by a stimulable phosphor layer. As illustrated in FIG. 4, after the stimulating rays have passed through a stimulable phosphor layer 42 and impinges upon a light reflecting layer 41, the stimulating rays iterate multiple scattering and again enter into the stimulable phosphor layer 42. In cases where one of the conventional pigments is employed in the light reflecting layer 41, the mean length of scattering (scattering length) of the stimulating rays is long. Therefore, in such cases, if the thickness of the light reflecting layer 41 is large, there is a strong probability that, after the stimulating rays having passed through the stimulable phosphor layer 42 impinges upon the light reflecting layer 41, the stimulating rays will emanate from the light reflecting layer 41 and will again enter into the stimulable phosphor layer 42 at a position spaced far apart from the position at which the stimulating rays having passed through the stimulable phosphor layer 42 impinged upon the light reflecting layer 41. Such a phenomenon is substantially equivalent to the phenomenon in which the stimulating rays (such as a laser beam) diffuse at the bottom region of the stimulable phosphor layer 42 (close to the light reflecting layer 41). As a result, the sharpness of the obtained image becomes low, and the image quality of the obtained image cannot much be enhanced. Specifically, in cases where the thickness of the light reflecting layer is set at a large value, the degree of diffusion of the stimulating rays within the thick light reflecting layer becomes high, and the increase in the thickness of the light reflecting layer does not directly result in enhancement of the image quality of the obtained radiation image. Such that the image quality of the obtained radiation image may be enhanced, a light reflecting layer, which contains a white pigment colored with ultramarine, or the like, such that the light reflecting layer absorbs a laser beam and absorbs little light emitted by a stimulable phosphor, has been proposed in, for example, Japanese Unexamined Patent Publication No. 59(1984)-162498. However, there is no pigment or dye, which does not at all absorb the light emitted by a stimulable phosphor. Therefore, with the proposed light reflecting layer, in cases where the thickness of the light reflecting layer is set at a large value, a decrease in the intensity of the light emitted by the stimulable phosphor cannot be eliminated perfectly. As a result, the graininess characteristics of the obtained radiation image inevitably become bad. It is thus desired that the image quality of the obtained radiation image as a whole be enhanced even further.

A radiation image storage panel provided with a light reflecting layer, in which polymer particles having a hollow structure are employed as a light reflecting substance, has been proposed in, for example, Japanese Unexamined Patent Publication No. 62(1987)-137598. The proposed radiation image storage panel aims at reducing the scattering length of the stimulating rays and obtaining the reflectivity with respect to the light emitted by a stimulable phosphor by use of the hollow polymer particles and by the utilization of a difference between a refractive index of air contained in the light reflecting layer and a refractive index of the polymer surrounding air. However, ordinarily, the refractive index of a polymer is smaller than the refractive index of a pigment. Therefore, the difference between the refractive index of the polymer and the refractive index of air cannot be set at a value larger than the refractive index of a pigment.

SUMMARY OF THE INVENTION

The primary object of the present invention is to provide a radiation image storage panel, which is capable of emitting light having a high intensity and furnishing a radiation image having good image quality with a high sharpness.

The present invention provides a radiation image storage panel, comprising a stimulable phosphor layer, which contains a stimulable phosphor, and a light reflecting layer, which contains a light reflecting substance and is overlaid on one surface of the stimulable phosphor layer, wherein a scattering length of the light reflecting layer with respect to light having wavelengths falling within a stimulation wavelength range for the stimulable phosphor is at most 5 $\mu$m.

Examples of the light reflecting substances include white pigments and hollow polymer particles. Examples of the white pigments include $Al_2O_3$, $ZrO_2$, $BaSO_4$, $SiO_2$, ZnS, ZnO, $CaCO_3$, $Sb_2O_3$, $Nb_2O_5$, $2PbCO_3.Pb(OH)_2$, MgO, $M^{II}FX$ (in which $M^{II}$ is at least one of Ba, Sr, and Ca, and X is at least one of Cl and Br), lithopone ($BaSO_4$+ZnS), magnesium silicate, basic lead silicosulfate, basic lead phosphate, and aluminum silicate. Among the above-enumerated light reflecting substances, the white pigments should preferably be employed. Also, in the radiation image storage panel in accordance with the present invention, the white pigment should preferably be selected from the group consisting of alumina, yttrium oxide, zirconium oxide, lead fluoride, yttrium oxychloride, and bismuth fluoride. As the light reflecting substance, each of the above-enumerated substances may be employed alone, or two or more of the above-enumerated substances may be employed in combination.

The term "scattering length" as used herein means the mean path, by which the light travels straightly before the light is scattered one time. A short scattering length represents high light scattering characteristics. The scattering length can be calculated from measured values, which are obtained with a technique described below, and with a calculation method in accordance with the Kubelka-Munk's theory.

Specifically, at least three light reflecting layer samples, which have the same composition as the composition of the light reflecting layer of the radiation image storage panel to be subjected to the measurement and which have different thicknesses are prepared. Thereafter, the thickness (in $\mu$m) and the diffuse transmittance (in %) of each sample are measured. The diffuse transmittance can be measured with an apparatus comprising an ordinary spectrophotometer and an integrating sphere. At this time, the measurement wavelength is set so as to coincide with the wavelength corresponding to the principal peak of the stimulation spectrum for the stimulable phosphor contained in the stimulable phosphor layer of the radiation image storage panel to be subjected to the measurement (600 nm is employed as a representative value of the wavelength corresponding to the principal peak), or the wavelength corresponding to the maximum peak (principal emission peak) of the emission spectrum of the stimulable phosphor (400 nm is employed as a representative value of the wavelength corresponding to the maximum peak). The measured values of the thickness (in $\mu$m) and the diffuse transmittance (in %) of the light reflecting layer sample, which have been obtained with the measurement described above, are substituted into a formula, which is derived from the Kubelka-Munk's theory. The formula shown below can be derived from, for example, Formulas 5.1.12 to 5.1.15, which are described in "Phosphor Handbook," edited by Keikotai Dogakkai, Ohm-Sha K. K., p. 403, 1987.

The thickness of the light reflecting layer is represented by d $\mu$m, and the reflectivity of the light reflecting layer is represented by do. Also, the scattering length of the light reflecting layer is represented by $1/\alpha$, and an absorption length of the light reflecting layer is represented by $1/\beta$. In this manner, a light intensity distribution I(Z) is considered. The light intensity distribution I(Z) may be divided into components i(Z) directed from the front surface of the light reflecting layer to the back surface of the light reflecting layer, and components j(Z) directed from the back surface of the light reflecting layer to the front surface of the light reflecting layer. Specifically, I(Z)=i(Z)+j(Z). In order for an increase and a decrease in light intensity due to scattering and absorption at a film having a fine thickness dz at an arbitrary depth to be calculated, the simultaneous differential equations shown below may be solved in accordance with the Kubelka-Munk's theory.

$$di/dz=-(\beta+\alpha)i+\alpha j \quad (1)$$

$$di/dz=(\beta+\alpha)j-\alpha i \quad (2)$$

The formulas shown below may be set.

$$\gamma^2=\beta(\beta+2\alpha)$$

$$\xi=(\alpha+\beta-\gamma)/\alpha$$

$$\eta=(\alpha+\beta+\gamma)/\alpha$$

The general solution of the simultaneous equations with respect to i is represented by the formula shown below.

$$i(z)=Ke^{-\gamma z}+Le^{\gamma z}$$

Also, the general solution of the simultaneous equations with respect to j is represented by the formula shown below.

$$j(z)=K\xi e^{-\gamma z}+L\eta e^{\gamma z}$$

The transmittance T of the light reflecting layer having the thickness d is given by the formula shown below.

$$T=i(d)/i(O)$$

In cases where the transmittance is measured with the light reflecting layer alone, if it is assumed that no return light occurs, i.e. j(d)=0, the transmittance may be expressed as a function of the thickness d of the light reflecting layer as shown below.

$$T(d)=(\eta-\xi)/(\eta e^{\gamma z}-\xi e^{-\gamma z}) \quad (3)$$

An optimum $1/\alpha$ value is calculated by fitting the measured transmittance values and the measured thickness values, which have been obtained from the measurement with the spectrophotometer, with the method of least squares, or the like. In this manner, the scattering length of the light reflecting layer is determined. The term "scattering length" as used herein is the one in accordance with the definition described above. In the radiation image storage panel in accordance with the present invention, the scattering length of the light reflecting layer, as measured in accordance with the definition described above, is at most 5 $\mu$m, and should preferably be at most 4 $\mu$m.

In order for the scattering length of the light reflecting layer to be set at a value of at most 5 $\mu$m, for example, the shape of the light reflecting substance may be deformed into a shape deviated from a spherical shape (e.g., into a shape having an uneven surface, a starfish-like shape, a star-like shape, or a confetto candy-like shape). Alternatively, for such purposes, the particle size of the light reflecting substance may be set at a value as close to the wavelengths as possible.

Specifically, the bulk density of the light reflecting substance should be set at a value of at most 1 mg/cm$^3$, and should preferably be set at a value of at most 0.6 mg/cm$^3$. Ordinarily, the bulk density is expressed with a value obtained by dividing the mass of particles by the bulk volume. The term "bulk density" as used herein means the closest packing bulk density. The term "closest packing bulk density" as used herein means the bulk density obtained when the light reflecting substance particles containing voids are packed most closely with vibration. The vibration may be performed mechanically or non-mechanically, e.g. manually.

Also, the BET specific surface area of the light reflecting substance should be set at a value of at least 1.5 m$^2$/g. The BET specific surface area of the light reflecting substance should preferably be set at a value falling within the range of 2 m$^2$/g to 10 m$^2$/g, and should more preferably be set at a value falling within the range of 2.5 m$^2$/g to 8 m$^2$/g. The term "BET specific surface area" as used herein means the surface area of the light reflecting substance per unit mass of the light reflecting substance.

Further, the mean particle size of the light reflecting substance should preferably fall within the range of 1/4 of the stimulation wavelengths to two times as large as the stimulation wavelengths. The stimulation wavelengths ordinarily employed fall within the range of 0.5 $\mu$m to 0.8 $\mu$m. Therefore, the mean particle size of the light reflecting substance should preferably fall within the range of 0.125 $\mu$m to 1.6 cm.

If the binder enters into voids formed by the light reflecting substance, a difference in refractive index will not be apt to occur, and the scattering length will become long. Therefore, the proportion of the binder in the light reflecting layer should preferably be as low as possible so as not to adversely affect the mechanical strength and the physical strength of the radiation image storage panel.

The radiation image storage panel in accordance with the present invention comprises the stimulable phosphor layer, which contains the stimulable phosphor, and the light reflecting layer, which contains the light reflecting substance and is overlaid on one surface of the stimulable phosphor layer, wherein the scattering length of the light reflecting layer with respect to light having wavelengths falling within the stimulation wavelength range for the stimulable phosphor is at most 5 $\mu$m. Therefore, the radiation image storage panel in accordance with the present invention is capable of emitting light having a high intensity and furnishing a radiation image having good image quality with a high sharpness. Specifically, with the light reflecting layer formed such that the scattering length is short, since the scattering length of each scattering path is short, there is a strong probability that, after the stimulating rays having passed through the stimulable phosphor layer impinges upon the light ref lecting layer, the stimulating rays will emanate from the light reflecting layer and will again enter into the stimulable phosphor layer at a position comparatively close to the position at which the stimulating rays having passed through the stimulable phosphor layer impinged upon the light reflecting layer. Accordingly, with the radiation image storage panel in accordance with the present invention, light having a high intensity is capable of being emitted when the radiation image storage panel is exposed to the stimulating rays, and a radiation image having good image quality with a high sharpness is capable of being obtained.

With the radiation image storage panel in accordance with the present invention, wherein the light reflecting substance is the white pigment selected from the group consisting of alumina, yttrium oxide, zirconium oxide, lead fluoride, yttrium oxychloride, and bismuth fluoride, since the white pigment particles themselves have a high refractive index, the scattering length is capable of being set more reliably at a value of 5 $\mu$m.

With the radiation image storage panel in accordance with the present invention, wherein the bulk density of the light reflecting substance is at most 1 mg/cm$^3$, wherein the BET specific surface area of the light reflecting substance is at least 1.5 m$^2$/g, or wherein the mean particle size of the light reflecting substance falls within the range of 1/4 of the stimulation wavelengths to two times as large as the stimulation wavelengths and is thus set at a value in the vicinity of the stimulation wavelengths, voids (air regions) are capable of being formed as much as possible in the light reflecting layer. Therefore, the particles of the light reflecting substance are capable of being dispersed such that they may not be in close contact with one another, and a high refractive index is capable of being obtained. As a result, the scattering length of at most 5 $\mu$m is capable of being obtained reliably.

In cases where the white pigment is colored with ultramarine, or the like, a high sharpness is capable of being obtained with a small amount of pigment. Therefore, absorption of the light emitted by the stimulable phosphor is capable of being restricted, a decrease in the intensity of the light emitted by the stimulable phosphor is capable of being minimized.

The present invention will hereinbelow be described in further detail with reference to the accompanying drawings.

DETAILED DESCRIPTION OF THE INVENTION

Figure 1:
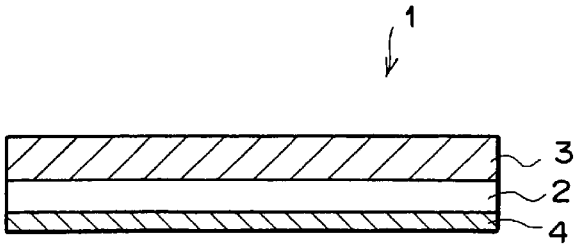
FIG. 1 is a sectional view showing an embodiment of the radiation image storage panel in accordance with the present invention.

FIG. 1 is a sectional view showing an embodiment of the radiation image storage panel in accordance with the present invention. As illustrated in FIG. 1, a radiation image storage panel 1 comprises a substrate 4, a stimulable phosphor layer 3, and a light reflecting layer 2, which is formed between the substrate 4 and the stimulable phosphor layer 3. The light reflecting layer may be formed on one surface of the stimulable phosphor layer. Alternatively, the substrate may be filled with a light reflecting substance such that the substrate may also act as the light reflecting layer.

The radiation image storage panel in accordance with the present invention will be described hereinbelow by taking a radiation image storage panel, which has a typical constitution comprising the substrate, the light reflecting layer, and the stimulable phosphor layer, as an example.

The substrate may be constituted of a material selected from various kinds of substrate materials, which are employed in known radiation image storage panels. Examples of the substrate materials include films of plastic substances, such as cellulose acetate, a polyester, a polyethylene terephthalate, a polyamide, a polyimide, a triacetate, and a polycarbonate; metal sheets, such as an aluminum foil and an aluminum alloy foil; and paper, such as ordinary paper, baryta paper, resin-coated paper, pigment paper containing a pigment, such as titanium dioxide, and paper sized with a polyvinyl alcohol, or the like. In cases where the constitution of the radiation image storage panel, characteristics of the radiation image storage panel required for an information recording material, and processing of the radiation image storage panel are taken into consideration, the substrate of the radiation image storage panel in accordance with the present invention should preferably be constituted of a plastic film. Such that the binding of the substrate of the radiation image storage panel with the light reflecting layer formed on the substrate to be enhanced, an adhesive property imparting layer constituted of a high-molecular weight substance, such as gelatin, may be formed on the substrate surface, on which the light reflecting layer is to be overlaid.

The light reflecting layer may be formed by preparing a coating composition containing the light reflecting substance described above, a binder, and a solvent, and uniformly applying the coating composition onto the substrate surface to form a coating film of the coating composition thereon. The binder and the solvent for the formation of the light reflecting layer may be selected from binders and solvents, which are employed for the formation of the stimulable phosphor layer. ordinarily, the mixing ratio of the binder to a white pigment in the coating composition for the formation of the light reflecting layer may be selected from the range between 1:1 and 1:50 (weight ratio). From the view point of the reflection characteristics of the light reflecting layer, the proportion of the binder should preferably be as low as possible. When the easiness of the formation of the light reflecting layer and the mechanical and physical strength of the radiation image storage panel are taken into consideration, the mixing ratio of the binder to the white pigment in the coating composition for the formation of the light reflecting layer should preferably be selected from the range between 1:2 and 1:20 (weight ratio). The thickness of the light reflecting layer should preferably fall within the range of 5 $\mu$m to 100 $\mu$m. The coating composition for the formation of the light reflecting layer may be applied with ordinary coating means, such as a doctor blade, a roll coater, or a knife coater. After the coating film of the coating composition is formed on the substrate surface, the coating film is heated little by little and dried. In this manner, the light reflecting layer is formed on the substrate.

The stimulable phosphor layer is formed on the light reflecting layer. A typical example of the stimulable phosphor layer comprises a binder and particles of a stimulable phosphor dispersed in the binder. As an example of the stimulable phosphor in the stimulable phosphor layer of the radiation image storage panel in accordance with the present invention, a bivalent europium activated barium fluorohalide stimulable phosphor may be employed.

Examples of the bivalent europium activated barium fluorohalide stimulable phosphors include the following:

a phosphor represented by the formula $(Ba_{1-x-y}, Mg_x, Ca_y)FX:aEu^{2+}$ wherein X is at least one of Cl and Br, x and y are numbers satisfying $0<x+y\leqq 0.6$ and $xy\neq 0$, and a is a number satisfying $10^{-6}\leqq a\leqq 5\times 10^{-2}$, as disclosed in DE-OS No. 2,928,245, a phosphor represented by the formula $(Ba_{1-x}.M^{2+}{}_x)FX:yA$ wherein $M^{2+}$ is at least one of Mg, Ca, Sr, Zn, and Cd, X is at least one of Cl, Br, and I, A is at least one of Eu, Tb, Ce, Tm, Dy, Pr, Ho, Nd, Yb, and Er, x is a number satisfying $0\leqq x\leqq 0.6$, and y is a number satisfying $0\leqq y\leqq 0.2$, as disclosed in U.S. Pat. No. 4,239,968, a phosphor represented by the formula BaFX.xA:yLn wherein A is at least one of BeO, MgO, CaO, SrO, BaO, ZnO, $Al_2O_3$, $Y_2O_3$, $La_2O_3$, $In_2O_3$, $SiO_2$, $TiO_2$, $ZrO_2$, $GeO_2$, $SnO_2$, $Nb_2O_5$, $Ta_2O_5$, and $ThO_2$, Ln is at least one of Eu, Tb, Ce, Tm, Dy, Pr, Ho, Nd, Yb, Er, Sm, and Gd, X is at least one of Cl, Br, and I, x is a number satisfying $5\times 10^{-5}\leqq x\leqq 0.5$, and y is a number satisfying $0<y\leqq 0.2$, as described in Japanese Unexamined Patent Publication No. 55(1980)-160078, a phosphor represented by the formula $(Ba_{1-x}, M^{II}{}_x)F_2.aBaX_2:yEu,zA$ wherein $M^{II}$ is at least one of beryllium, magnesium, calcium, strontium, zinc, and cadmium, X is at least one of chlorine, bromine, and iodine, A is at least one of zirconium and scandium, a is a number satisfying $0.5\leqq a\leqq 1.25$, x is a number satisfying $0\leqq x\leqq 1$, y is a number satisfying $10^{-6}\leqq y\leqq 2\times 10^{-1}$, and z is a number satisfying $0<z\leqq 10^{-2}$, as described in Japanese Unexamined Patent Publication No. 56(1981)-116777, a phosphor represented by the formula $(Ba_{1-x}, M^{II}{}_x)F_2.aBaX_2:yEu,zB$ wherein $M^{II}$ is at least one of beryllium, magnesium, calcium, strontium, zinc, and cadmium, X is at least one of chlorine, bromine, and iodine, a is a number satisfying $0.5\leqq a\leqq 1.25$, x is a number satisfying $0\leqq x\leqq 1$, y is a number satisfying $10^{-6}\leqq y\leqq 2\times 10^{-1}$, and z is a number satisfying $0<z\leqq 2\times 10^{-1}$, as described in Japanese Unexamined Patent Publication No. 57(1982)-23673, a phosphor represented by the formula $(Ba_{1-x}, M^{II}{}_x)F_2.aBaX_2:yEu,zA$ wherein $M^{11}$ is at least one of beryllium, magnesium, calcium, strontium, zinc, and cadmium, X is at least one of chlorine, bromine, and iodine, A is at least one of arsenic and silicon, a is a number satisfying $0.5\leqq a\leqq 1.25$, x is a number satisfying $0\leqq x\leqq 1$, y is a number satisfying $10^{-6}\leqq y\leqq 2\times 10^{-1}$, and z is a number satisfying $0<z\leqq 5\times 10^{-1}$, as described in Japanese Unexamined Patent Publication No. 57(1982)-23675, a phosphor represented by the formula $Ba_{1-x}M_{x/2}L_{x/2}FX:yEu^{2+}$ wherein M is at least one alkaline metal selected from the group consisting of Li, Na, K, Rb, and Cs, L is at least one trivalent metal selected from the group consisting of Sc, Y, La, Ce, Pr, Nd, Pm, Sm, Gd, Tb, Dy, Ho, Er, Tm, Yb, Lu, Al, Ga, In, and Tl, X is at least one halogen selected from the group consisting of Cl, Br, and I, x is a number satisfying $10^2\leqq x\leqq 0.5$, and y is a number satisfying $0<y\leqq 0.1$, as described in Japanese Unexamined Patent Publication No. 58(1983)-206678, a phosphor represented by the formula $BaFX.xA:yEu^{2+}$ wherein X is at least one halogen selected from the group consisting of Cl, Br, and I, A is a calcination product of a tetrafluoroboric acid compound, x is a number satisfying $10^{-6}\leqq x\leqq 0.1$, and y is a number satisfying $0<y\leqq 0.1$, as described in Japanese Unexamined Patent Publication No. 59(1984)-27980, a phosphor represented by the formula $BaFX.xA:yEu^{2+}$ wherein X is at least one halogen selected from the group consisting of Cl, Br, and I, A is a calcination product of at least one compound selected from the hexafluoro compound group consisting of salts of hexafluorosilicic acid, hexafluorotitanic acid, and hexafluorozirconic acid with monovalent or bivalent metals, x is a number satisfying $10^{-6}\leqq x\leqq 0.1$, and y is a number satisfying $0<y\leqq 0.1$, as described in Japanese Unexamined Patent Publication No. 59(1984)-47289, a phosphor represented by the formula $BaFX.xNaX':aEu^{2+}$ wherein each of X and X' is at least one of Cl, Br, and I, x is a number satisfying $0<x\leqq 2$, and a is a number satisfying $0<a\leqq 0.2$, as described in Japanese Unexamined Patent Publication No. 59(1984)-56479, a phosphor represented by the formula $BaFX.xNaX':yEu^{2+}:zA$ wherein each of X and X' is at least one halogen selected from the group consisting of Cl, Br, and I, A is at least one transition metal selected from the group consisting of V, Cr, Mn, Fe, Co, and Ni, x is a number satisfying $0<x\leqq 2$, y is a number satisfying $0<y\leqq 0.2$, and z is a number satisfying $0<z\leqq 10^{-2}$, as described in Japanese Unexamined Patent Publication No. 59(1984)-56480, a phosphor represented by the formula $BAFX.aM^{I}X'.bM^{II}X''_2.cM^{III}X'''_3.\ xA:yEu^{2+}$ wherein $M^{I}$ is at least one alkali metal selected from the group consisting of Li, Na, K, Rb, and Cs, $M^{II}$ is at least one bivalent metal selected from the group consisting of Be and Mg, $M^{III}$ is at least one trivalent metal selected from the group consisting of Al, Ga, In, and Tl, A is a metal oxide, X is at least one halogen selected from the group consisting of Cl, Br, and I, each of X', XI", and X"' is at least one halogen selected from the group consisting of F, Cl, Br, and I, a is a number satisfying $0 \leqq a \leqq 2$, b is a number satisfying $0 \leqq b \leqq 10^{-2}$, c is a number satisfying $0 \leqq c \leqq 10^{-2}$, and $a+b+c \geqq 10^{-6}$, x is a number satisfying $0 < x \leqq 0.5$, and y is a number satisfying $0 < y \leqq 0.2$, as described in Japanese Unexamined Patent Publication No. 59(1984)-75200, a stimulable phosphor represented by the formula $BaX_2.aBaX'_2:xEu^{2+}$ wherein each of X and X' is at least one halogen selected from the group consisting of Cl, Br, and I, and $X \neq X'$, a is a number satisfying $0.1 \leqq a \leqq 10.0$, and x is a number satisfying $0 < x \leqq 0.2$, as described in Japanese Unexamined Patent Publication No. 60(1985)-84381, a stimulable phosphor represented by the formula $BaFX.aM^{I}X':xEu^{2+}$ wherein $M^{I}$ is at least one alkali metal selected from the group consisting of Rb and Cs, X is at least one halogen selected from the group consisting of Cl, Br, and I, X' is at least one halogen selected from the group consisting of F, Cl, Br, and I, a is a number satisfying $0 \leqq a \leqq 4.0$, and x is a number satisfying $0 < x \leqq 0.2$, as described in Japanese Unexamined Patent Publication No. 60(1985)-101173, and a stimulable phosphor represented by the formula $(Ba_{1-a}, M^{II}_{a})F(Br_{1-b},I_b).cNaX.dCsX'.eA:xEu^{2+}$ wherein $M^{II}$ is Sr or Ca, each of X and X' is Cl, Br, or I, A is $Al_2O_3$, $SiO_2$, or $ZrO_2$, a is a number satisfying $0 < a \leqq 0.5$, b is a number satisfying $0 < b < 1$, c is a number satisfying $0 < c \leqq 2$, d is a number satisfying $5 \times 10^{-5} \leqq d \leqq 5 \times 10^{-2}$, e is a number satisfying $5 \times 10^{-5} \leqq e \leqq 0.5$, and x is a number satisfying $0 < x \leqq 0.2$, as described in Japanese Unexamined Patent Publication No. 63(1988)-101478.

The stimulable phosphor layer may be formed by preparing a coating composition containing the stimulable phosphor described above, a binder, and a solvent, and uniformly applying the coating composition onto the surface of the light reflecting layer to form a coating film of the coating composition thereon. The coating composition for the formation of the stimulable phosphor layer may be applied with ordinary coating means, such as a doctor blade, a roll coater, or a knife coater. After the coating film of the coating composition is formed on the surface of the light reflecting layer, the coating film is heated little by little and dried. In this manner, the stimulable phosphor layer is formed on the light reflecting layer. The thickness of the stimulable phosphor layer may vary in accordance with the characteristics required of the radiation image storage panel, the kind of the stimulable phosphor, the mixing ratio of the binder to the stimulable phosphor, and the like. The thickness of the stimulable phosphor layer ordinarily falls within the range of 20 μm to 1 mm, and should preferably fall within the range of 50 μm to 500 μm.

The formation of the stimulable phosphor layer need not necessarily be performed in the manner described above by directly applying the coating composition on the light reflecting layer. For example, a stimulable phosphor layer may be formed previously by applying the coating composition onto a plate, such as a glass plate, a metal plate, or a plastic sheet, and drying the coating film of the coating composition. After the thus formed stimulable phosphor layer is separated from the plate, the stimulable phosphor layer may be pushed against and overlaid on the light reflecting layer. Alternatively, the stimulable phosphor layer may be adhered to the light reflecting layer by use of an adhesive agent.

The white pigment may be filled in the stimulable phosphor layer together with the stimulable phosphor. In such cases, the ratio (weight ratio) of the stimulable phosphor to the white pigment should preferably fall within the range between 100:1 and 100:20. In cases where the white pigment is introduced into the stimulable phosphor layer, a light reflecting layer for reflecting the stimulating rays may be formed on one surface of the stimulable phosphor layer.

Ordinarily, a transparent protective film constituted of a plastic material for physically and chemically protecting the stimulable phosphor layer is formed on the surface of the stimulable phosphor layer, which surface is opposite to the substrate side surface. The radiation image storage panel in accordance with the present invention should preferably be provided with such a transparent protective film. The protective film may be formed on the stimulable phosphor layer with, for example, a technique, wherein a plastic film is prepared previously and is then adhered to the surface of the stimulable phosphor layer with an adhesive agent. Alternatively, the protective film may be formed on the stimulable phosphor layer with a technique, wherein a coating composition containing a protective film material is applied onto the surface of the stimulable phosphor layer and is then dried. A fine particle filler may be contained in the protective layer in order to reduce interference nonuniformity and enhance the image quality of the radiation image. Examples of resins appropriate for the production of the light-permeable plastic film include polyester resins, such as a polyethylene terephthalate and a polyethylene naphthalate; and cellulose ester derivatives, such as cellulose triacetate. For the production of the light-permeable plastic film, various resin materials, such as a polyolefin and a polyamide, may also be employed. The thickness of the protective film should preferably fall within the range of approximately 3 μm to approximately 20 μm.

The present invention will further be illustrated by the following non-limitative examples.

EXAMPLE 1

A coating composition for the formation of a light reflecting layer was prepared by adding 100 g of yttrium oxide particles (particle diameters of 90 wt. % particles among all particles: 0.1 μm to 1 μm, mean particle size of all particles: 0.6 μm, refractive index: 1.8), 8 g of a binder (a soft acrylic resin), and 2 g of a phthalic ester into methyl ethyl ketone, and subjecting the resulting mixture to a dispersing process, which was performed with a propeller mixer. The thus prepared coating composition for the formation of a light reflecting layer was then uniformly applied onto a transparent polyethylene terephthalate film (acting as a substrate, thickness: 250 μm) with a doctor blade, and the thus formed coating film was dried. In this manner, a light reflecting layer having a thickness of 50 μm was formed on the substrate.

A coating composition for the formation of a stimulable phosphor layer was prepared by adding 200 g of a stimulable phosphor ($BaFBr_{0.85}I_{0.15}:Eu^{2+}$, mean particle size: 5 μm), a binder (a polyurethane: Desmolac 4125, supplied by Sumitomo Bayer Urethane K.K., solid content: 22.5 g), and 1.4 g of an anti-yellowing agent (an epoxy resin: Epikote 1004, supplied by Yuka Shell Epoxy K.K.) into methyl ethyl ketone, and subjecting the resulting mixture to a dispersing process. The thus prepared coating composition for the Information of a stimulable phosphor layer was then uniformly applied onto a polyethylene terephthalate sheet (acting as a temporary substrate, thickness: 180 μm), which had been coated with a silicon type of releasing agent, with a doctor blade, and the thus formed coating film was dried.

In this manner, a stimulable phosphor layer having a thickness of 350 μm was formed.

The thus formed stimulable phosphor layer was then separated from the temporary substrate and overlaid on the light reflecting layer, which had been formed on the substrate in the manner described above, to form a laminate. The thus obtained laminate was then passed between two heated rolls (roll temperature: 70° C.) under the conditions of a roll pressure of 500 kgw/cm and a feed rate of 1 m/minute. In this manner, the stimulable phosphor layer was adhered to the light reflecting layer having been formed on the substrate. At this time, the thickness of the stimulable phosphor layer became equal to 270 μm.

Thereafter, a polyethylene terephthalate film (acting as a transparent protective layer, thickness: 10 μm) was adhered to the stimulable phosphor layer. In this manner, a radiation image storage panel comprising the substrate, the light reflecting layer, the stimulable phosphor layer, and the transparent protective layer was obtained.

EXAMPLE 2

A radiation image storage panel was formed in the same manner as that in Example 1, except that the thickness of the stimulable phosphor layer was set at 300 μm.

EXAMPLE 3

A radiation image storage panel was formed in the same manner as that in Example 1, except that the thickness of the stimulable phosphor layer was set at 240 μm.

EXAMPLE 4

A radiation image storage panel was formed in the same manner as that in Example 1, except that a light reflecting layer was formed in the manner described below. Specifically, in Example 4, a coating composition for the formation of a light reflecting layer was prepared by adding 100 g of non-spheric alumina particles (mean particle size: 0.4 μm, bulk density: 0.5 g/cm$^2$, BET specific surface area: 2 m$^2$/g), 4 g of a binder (a soft acrylic resin), and 1 g of a phthalic ester into methyl ethyl ketone, and subjecting the resulting mixture to a dispersing process, which was performed with a propeller mixer. The thus prepared coating composition for the formation of a light reflecting layer was then uniformly applied onto a transparent polyethylene terephthalate film (acting as a substrate, thickness: 250 μm) with a doctor blade, and the thus formed coating film was dried. In this manner, a light reflecting layer having a thickness of 50 μm was formed on the substrate.

EXAMPLE 5

A radiation image storage panel was formed in the same manner as that in Example 4, except that the thickness of the stimulable phosphor layer was set at 300 μm.

EXAMPLE 6

A radiation image storage panel was formed in the same manner as that in Example 4, except that the thickness of the stimulable phosphor layer was set at 240 μm.

COMPARATIVE EXAMPLE 1

A radiation image storage panel was formed in the same manner as that in Example 1, except that, in lieu of the yttrium oxide particles, particles of gadolinium oxide $Gd_2O_3$ (particle diameters of 90 wt. % particles among all particles: 1 μm to 5 μm, mean particle size of all particles: 2.2 μm) were employed as the pigment in the light reflecting layer.

COMPARATIVE EXAMPLE 2

A radiation image storage panel was formed in the same manner as that in Comparative Example 1, except that the thickness of the stimulable phosphor layer was set at 300 μm.

COMPARATIVE EXAMPLE 3

A radiation image storage panel was formed in the same manner as that in Comparative Example 1, except that the thickness of the stimulable phosphor layer was set at 240 μm.

COMPARATIVE EXAMPLE 4

A radiation image storage panel was formed in the same manner as that in Example 4, except that a light reflecting layer was formed by use of alumina particles (mean particle size: 0.4 μm, bulk density: 1.1 g/cm$^2$, BET specific surface area: 1 m$^2$/g) having a shape closer to a spheric shape than the shape of the alumina particles employed in Example 4 was.

COMPARATIVE EXAMPLE 5

A radiation image storage panel was formed in the same manner as that in Comparative Example 4, except that the thickness of the stimulable phosphor layer was set at 300 μm.

COMPARATIVE EXAMPLE 6

A radiation image storage panel was formed in the same manner as that in Comparative Example 4, except that the thickness of the stimulable phosphor layer was set at 240 μm.

COMPARATIVE EXAMPLE 7

A radiation image storage panel was formed in the same manner as that in Comparative Example 4, except that 10 mg of ultramarine was added when the coating composition for the formation of a light reflecting layer was prepared.

COMPARATIVE EXAMPLE 8

A radiation image storage panel was formed in the same manner as that in Comparative Example 7, except that the thickness of the stimulable phosphor layer was set at 300 μm.

COMPARATIVE EXAMPLE 9

A radiation image storage panel was formed in the same manner as that in Comparative Example 7, except that the thickness of the stimulable phosphor layer was set at 240 μm.

The mean particle sizes, the bulk densities, and the BET specific surface areas of the light reflecting substances employed in Examples 1 to 6 and Comparative Examples 1 to 9 are listed in Table 1 below.

TABLE 1

| | Mean particle size (μm) | Bulk density g/cm$^2$ | BET specific surface area m$^2$/g |
|---|---|---|---|
| Examples 1~3 | 0.6 | | |
| Examples 4~6 | 0.4 | 0.5 | 2 |
| Comp. Ex. 1~3 | 2.2 | | |
| Comp. Ex. 4~6 | 0.4 | 1.1 | 1 |
| Comp. Ex. 7~9 | 0.4 | 1.1 | 1 |

Calculation of Scattering Length of Light Reflecting Layer:

At least three light reflecting layer samples, which had the same composition as the composition of the light reflecting layer of the radiation image storage panel to be subjected to the measurement and which had different thicknesses, were prepared. Thereafter, the thickness (in MAm) and the diffuse transmittance (in %) of each sample were measured. The diffuse transmittance was measured with an apparatus comprising an automatic recording spectrophotometer (U-3210, supplied by Hitachi, Ltd.) and a 150-diameter integrating sphere (150-0901). The measured values of the thickness (in μm) and the diffuse transmittance (in %) of the light reflecting layer sample, which had been obtained with the measurement described above, were substituted into the formula, which was derived from the Kubelka-Munk, s theory, and the scattering length of the light reflecting layer was thereby calculated. At this time, the measurement wavelength was set so as to coincide with the wavelength corresponding to the principal peak of the stimulation spectrum for the stimulable phosphor contained in the stimulable phosphor layer of the radiation image storage panel to be subjected to the measurement (600 nm was employed as a representative value of the wavelength corresponding to the principal peak), or the wavelength corresponding to the maximum peak (principal emission peak) of the emission spectrum of the stimulable phosphor (400 nm was employed as a representative value of the wavelength corresponding to the maximum peak). The scattering lengths of the light reflecting layers having been calculated in the manner described above are listed in Table 2 below.

TABLE 2

| | Scattering length of light reflecting layer (μm) |
|---|---|
| Examples 1~3 | 2.5 |
| Examples 4~6 | 3.5 |
| Comp. Ex. 1~3 | 8 |
| Comp. Ex. 4~6 | 6.5 |
| Comp. Ex. 7~9 | 6.5 |

Evaluation of Radiation Image Storage Panel:

As for each of the radiation image storage panels obtained in Examples 1 to 6 and Comparative Examples 1 to 9, the relationship between sharpness (the modulation transfer function (MTF) value at a frequency of 2 cycles/mm) and the intensity of light emitted by the stimulable phosphor (relative value) was investigated under the conditions of a tube voltage of 80 kVp and by utilizing a He-Ne laser beam as the stimulating rays. The results shown in FIG. 2 were obtained. FIG. 3 shows how the stimulating rays are scattered in each of the light reflecting layers of the radiation image storage panels obtained in Examples 1 to 6.

Figure 2:
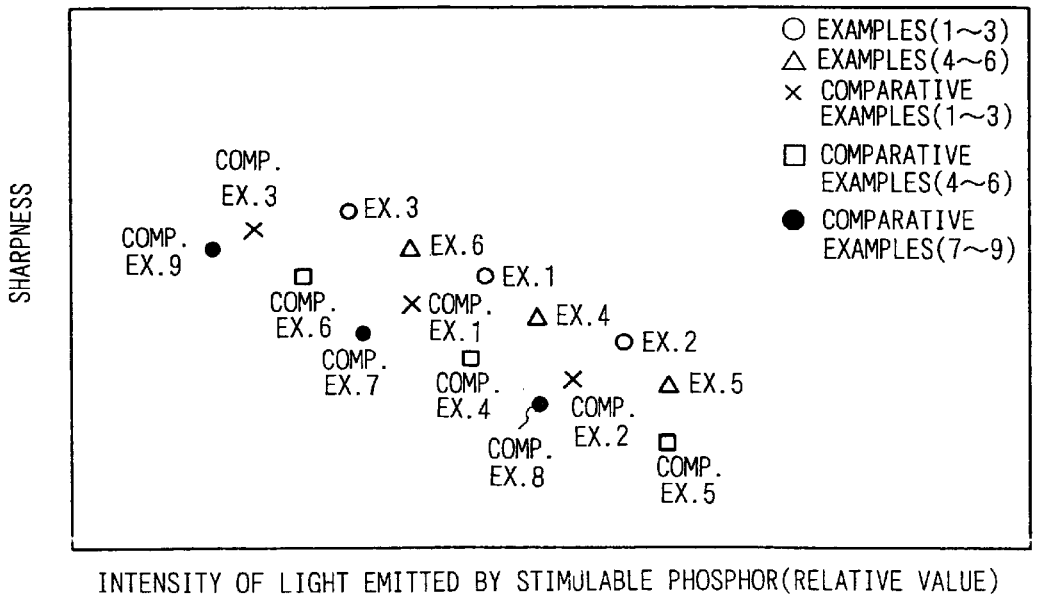
FIG. 2 is a graph showing relationship between sharpness and an intensity of light emitted by a stimulable phosphor layer.
Figure 3:
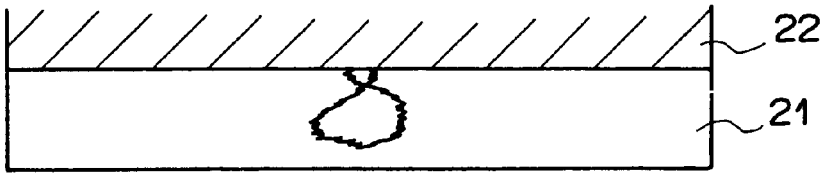
FIG. 3 is an explanatory view showing how stimulating rays incident upon a light reflecting layer of the radiation image storage panel in accordance with the present invention are scattered in the light reflecting layer.
Figure 4:
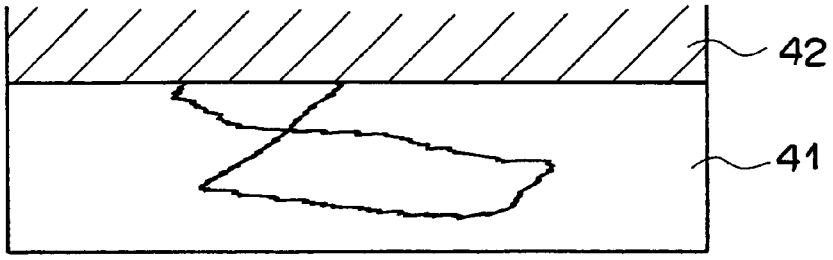
FIG. 4 is an explanatory view showing how stimulating rays incident upon a light reflecting layer are scattered in the light reflecting layer in cases where the thickness of the light reflecting layer is set at a large value so as to obtain a high reflectivity of the light reflecting layer with respect to light emitted by a stimulable phosphor layer.

As clear from Table 1, Table 2, and FIG. 2, in cases where the scattering length of the light reflecting layer is at most 5 μm (in Examples 1 to 6), a radiation image having a high sharpness can be obtained. Specifically, in cases where the scattering length of the light reflecting layer is at most 5 μm, as illustrated in FIG. 3, after the stimulating rays having passed through a stimulable phosphor layer 22 impinges upon a light reflecting layer 21, the stimulating rays emanate from the light reflecting layer 21 and again enter into the stimulable phosphor layer 22 at a position close to the position at which the stimulating rays having passed through the stimulable phosphor layer 22 impinged upon the light reflecting layer 21. Therefore, little decrease in sharpness occurs. In order for the scattering length of the light reflecting layer to be set at a value of at most 5 μm, as in Examples 1 to 6, the mean particle size of the light reflecting substance may be set so as to fall within the range of 1/4 of the stimulation wavelengths to two times as large as the stimulation wavelengths.

In cases where the mean particle diameter of the light reflecting substance is kept the same, if the bulk density of the light reflecting substance is at most 1 mg/cm$^3$ or the BET specific surface area of the light reflecting substance is at least 1.5 m$^2$/g as in Examples 4, 5, and 6, it is possible to obtain a radiation image having a higher sharpness than in cases where the bulk density of the light reflecting substance is higher than 1 mg/cm$^3$ or the BET specific surface area of the light reflecting substance is smaller than 1.5 m$^2$/g as in Comparative Examples 4, 5, and 6. In Comparative Examples 7, 8, and 9, the light reflecting layers in the radiation image storage panels of Comparative Examples 4, 5, and 6 are colored with ultramarine. It can be found that, in such cases, since absorption of the light emitted by the stimulable phosphor occurs due to ultramarine, the intensity of the light emitted by the stimulable phosphor decreases slightly.

In addition, all of the contents of Japanese Patent Application No. 11(1999)-303914 are incorporated into this specification by reference.

What is claimed is:

1. A radiation image storage panel, comprising:

a substrate; CD a stimulable phosphor layer containing a stimulable phosphor; and a light reflecting layer arranged between the substrate and the stimulable phosphor layer, wherein the light reflecting layer contains a light reflecting substance, and wherein a scattering length of the light reflecting layer with respect to light having wavelengths falling within a stimulation wavelength range for the stimulable phosphor is at most 5 μm.

2. A radiation image storage panel as defined in claim 1 wherein the light reflecting substance is a white pigment.

3. A radiation image storage panel as defined in claim 2 wherein the light reflecting substance has a bulk density of at most 1 mg/cm$^3$.

4. A radiation image storage panel as defined in claim 3 wherein the light reflecting substance has a BET specific surface area of at least 1.5 m$^2$/g.

5. A radiation image storage panel as defined in claim 2 wherein the light reflecting substance has a BET specific surface area of at least 1.5 m$^2$/g.

6. A radiation image storage panel as defined in claim 2, 3, 5, or 4 wherein the white pigment is selected from the group consisting of alumina, yttrium oxide, zirconium oxide, lead fluoride, yttrium oxychloride, and bismuth fluoride.

7. A radiation image storage panel as defined in claim 6 wherein the light reflecting substance has a mean particle size falling within the range of 1/4 of the stimulation wavelengths to two times as large as the stimulation wavelengths.

8. A radiation image storage panel as defined in claim 1 wherein the light reflecting substance has a bulk density of at most 1 $mg/cm^3$.

9. A radiation image storage panel as defined in claim 8 wherein the light reflecting substance has a BET specific surface area of at least 1.5 $m^2/g$.

10. A radiation image storage panel as defined in claim 1 wherein the light reflecting substance has a BET specific surface area of at least 1.5 $m^2/g$.

11. A radiation image storage panel as defined in claim 1, 2, 8, 3, 10, 5, 9, or 4 wherein the light reflecting substance has a mean particle size falling within the range of 1/4 of the stimulation wavelengths to two times as large as the stimulation wavelengths.

* * * * *